US006107895A

United States Patent [19]

Butland et al.

[11] Patent Number: 6,107,895

[45] Date of Patent: Aug. 22, 2000

[54] CIRCULATOR AND COMPONENTS THEREOF

[75] Inventors: Roger John Butland; Alexander Grigorievich Schuchinsky; Gerald Leigh Therkleson, all of Wellington, New Zealand

[73] Assignee: Deltec Telesystems International Limited, Wellington, New Zealand

[21] Appl. No.: 09/155,233

[22] PCT Filed: Apr. 2, 1997

[86] PCT No.: PCT/NZ97/00045

§ 371 Date: Sep. 23, 1998

§ 102(e) Date: Sep. 23, 1998

[87] PCT Pub. No.: WO97/39492

PCT Pub. Date: Oct. 23, 1997

[30] Foreign Application Priority Data

Apr. 3, 1996 [NZ] New Zealand ..... 286317

[51] Int. Cl.[7] ..... H01P 1/383

[52] U.S. Cl. ..... 333/1.1; 29/882; 29/884

[58] Field of Search ..... 333/1.1, 24.2; 29/882, 884

[56] References Cited

U.S. PATENT DOCUMENTS

| | | | |
|---|---|---|---|
| 3,030,593 | 4/1962 | Von Aulock . | |
| 3,334,318 | 8/1967 | Nakahara et al. . | |
| 3,716,805 | 2/1973 | Knerr | 333/1.1 |
| 3,836,874 | 9/1974 | Maeda et al. . | |
| 4,034,377 | 7/1977 | Knox et al. . | |
| 4,174,506 | 11/1979 | Ogawa . | |
| 4,246,552 | 1/1981 | Fukasawa et al. . | |
| 4,258,339 | 3/1981 | Bernard et al. . | |
| 4,276,522 | 6/1981 | Coerver . | |
| 4,390,853 | 6/1983 | Mathew et al. . | |
| 4,471,329 | 9/1984 | Cavalieri d'Oro . | |
| 4,749,965 | 6/1988 | Prevot et al. . | |
| 4,789,844 | 12/1988 | Schloemann . | |
| 4,812,787 | 3/1989 | Kuramoto et al. . | |
| 4,920,323 | 4/1990 | Schloemann et al. . | |
| 5,068,629 | 11/1991 | Nishikawa et al. . | |
| 5,153,537 | 10/1992 | Desmarest . | |
| 5,285,174 | 2/1994 | Al-Bundak et al. . | |
| 5,379,004 | 1/1995 | Marusawa et al. . | |
| 5,384,556 | 1/1995 | Coles et al. . | |

FOREIGN PATENT DOCUMENTS

| | | | |
|---|---|---|---|
| 0 293 013 | 11/1988 | European Pat. Off. . | |
| 0 675 561 | 10/1995 | European Pat. Off. . | |
| 2 354 643 | 1/1978 | France . | |
| 2 671 912 | 7/1992 | France . | |
| 29 50 632 | 6/1981 | Germany . | |
| 31 34 874 | 3/1983 | Germany . | |
| 1-318403 | 12/1989 | Japan . | |
| 6-196907 | 7/1994 | Japan | 333/1.1 |
| 1 449 291 | 9/1976 | United Kingdom . | |
| WO 86/04739 | 8/1986 | WIPO . | |
| WO 95/01659 | 1/1995 | WIPO . | |

OTHER PUBLICATIONS

Ernst F. Schloemann "Circulators for Microwave and Millimeter—Wave Integrated Circuits" *Proceedings of the IEEE*, vol. 76, No. 2, pp. 188–200.

Oct. 1997, PCT International Search Report.

*Primary Examiner*—Paul Gensler

*Attorney, Agent, or Firm*—Merchant and Gould P.C.

[57] ABSTRACT

A circulator having integrally formed conductors (20, 21, and 22) which may be folded to form overlaying conductors of a circulator. The circulator includes a lens (44) for shaping a biasing magnetic field distribution to compensate for non-uniformity of magnetic field strength caused by irregularities of a magnetic circuit or the shape of a magnet (45) or ferrite (40, 41). The characteristics of ferrite discs (40, 41) are preferably correlated with the characteristics of a permanent magnet (45) so that variations of permeability of the ferrite (40, 41) are minimized over a specified temperature range.

15 Claims, 12 Drawing Sheets

CIRCULATOR AND COMPONENTS THEREOF

TECHNICAL FIELD

The present invention relates to a radio frequency circulator/isolator and components thereof. The circulator/isolator (called hereafter a "circulator" for brevity) is a non-reciprocal device often used for discriminating and/or diverting oppositely directed signals transmitted through a network.

BACKGROUND OF THE INVENTION

Circulators generally contain two basic parts:

i/ a microwave circuit comprising an arrangement of conductors and ferrite blocks, and ii/ a magnetic circuit providing a magnetic biasing field applied to the ferrite blocks that act as a non-reciprocal media for propagating radio frequency signals throughout the device.

An ideal three port circulator transmits power (as shown diagrammatically in FIG. 1) between any two ports in a forward direction only, i.e. from port 1 to port 2, from port 2 to port 3, from port 3 to port 1. In the reverse direction (from port 1 to port 3, from port 3 to port 2 and from port 2 to port 1) no power can be transmitted (i.e. port 3 is isolated from port 1, port 2 from port 3, and port 1 from port 2).

A circulator can be converted to an isolator by connecting a matched load to one of the ports. For example, if port 3 is terminated with a matched load, a drive signal is applied to input port 1 and an antenna is connected to output port 2, then any power reflected from the antenna is directed to the terminated port 3 and dissipated in the load.

A typical prior art strip line lumped element circulator is shown in FIGS. 2 and 3. Conductors 4 connected to terminal ports are sandwiched between ferrite discs 5 and 6 which in turn are located in the gap between magnets 7 and 8. Permanent magnets 7 and 8 are supposed to magnetise ferrite disks 5 and 6 and provide a dc biasing magnetic field in the ferrite disks 5,6 that is necessary for signal circulation between terminal ports. The direction of circulation is determined by the orientation of the applied dc magnetic field and may be reversed by reversing the polarity of the magnets 7,8.

In such prior devices conductors 4*a*, 4*b*, and 4*c* form a multi-layered construction where individual strips are interwoven and their intersections are insulated during assembly. The conductor ends (9*a*, 9*b*, 9*c*) are connected to terminal ports of the circulator and the other ends (10*a*, 10*b*, 10*c*) are attached to a common ground plane.

The pattern of interwoven conductors 4 may be fabricated in two different ways. One approach is based on interweaving and joining separate insulated strip conductors. The other technique employs the technology of multi-layered metal and dielectric deposition on the surface of a ferrite disk. The former method is time consuming and the resulting conductor assemblies may have inconsistent topology. The latter procedure exploits thin film technology and is typically useful in fabrication of low power microwave integrated devices. Increasing power handling capacity may result in a substantial rise in manufacturing cost. Another problem encountered by both fabricating methods is the quality of the connections between conductor ends (10*a*, 10*b*, 10*c*) and the common ground plane, the inconsistent joints causing increased losses and degradation of overall circulator performance.

Homogeneity of the biasing magnetic field inside the ferrite disks is normally desirable for optimum circulator performance. Non-uniformity of the biasing magnetic field associated with the shape of magnets and ferrite blocks may substantially degrade insertion losses and isolation between the circulator ports. The crucial problem of optimising distribution of the biasing magnetic field has been extensively explored and addressed in numerous publications and patents.

In particular, to generate a uniform magnetic field inside ferrite disks it has been proposed to attach ferrite semi-spheres either side of the ferrite discs (see E. F. Schloemann. "Circulators for Microwave and Millimeter-Wave Integrated Circuits". Proceedings of IEEE, vol. 76, No.2, February 1988, pp 188–200). Semi-spherical ferrite segments surrounding the ferrite disks neutralise the demagnetising effect of the disk-shaped ferrites on distribution of the internal biasing magnetic field. They help to preserve uniformity of the internal magnetic field when the system is exposed to a uniform external magnetic field. However, such an arrangement is bulky and only employs the central part of the magnetic system due to tight requirements of homogeneity in the external magnetic field. Ferrite semi-spherical segments are also expensive to produce and, due to the very poor thermal conductivity of ferrite, they impede heat transfer from the ferrite disks. The latter problem may result in substantial degradation of circulator performance with increasing power and/or varying temperature.

DE 2950632 discloses the use of frustoconical ferrites in a junction circulator. This is said to reduce noise and intermodulations by minimising the effect of irregularities in the biasing magnetic field nearby the edge of the ferrite. This, however, requires special fabrication techniques, thus increasing cost. This also increases the thickness of ferrite used, thus impeding heat transfer.

Further, in prior art circulators the ferrite was considered simply as part of the microwave circuit not affecting the DC magnetic circuit. This often resulted in difficulties of thermal stabilisation and the need for complex temperature controlling devices.

DISCLOSURE OF THE INVENTION

It is an object of the present invention to provide a circulator and components thereof which overcome or at least minimise the disadvantages mentioned above, or which at least provides the public with a useful choice.

According to a first aspect of the invention there is provided an integral conductor arrangement for a circulator comprising a plurality of overlying spaced apart crossing strips attached at one end to a base portion having an opening therein, and forming a first compartment adapted for receiving a ferrite block therein such that the ferrite block may be inserted into the first compartment with one face of the ferrite block located adjacent the strips while an opposite face of the ferrite block is exposed to allow direct contact with a circulator housing body.

There is further provided a method of forming a conductor arrangement for a circulator comprising the steps of:

i) forming an integral conductor arrangement consisting of a plurality of strips extending outwardly from a base portion having an opening therein;

ii) folding the arrangement to define a first compartment to accommodate a ferrite block; and iii) folding the strips inwardly without a ferrite block being inserted into the first compartment to form an arrangement of spaced apart overlaying crossing strips.

BRIEF DESCRIPTION OF THE DRAWINGS

The invention will now be described by way of example with reference to the accompanying drawings in which.

BEST MODE FOR CARRYING OUT THE INVENTION

Figure 1:
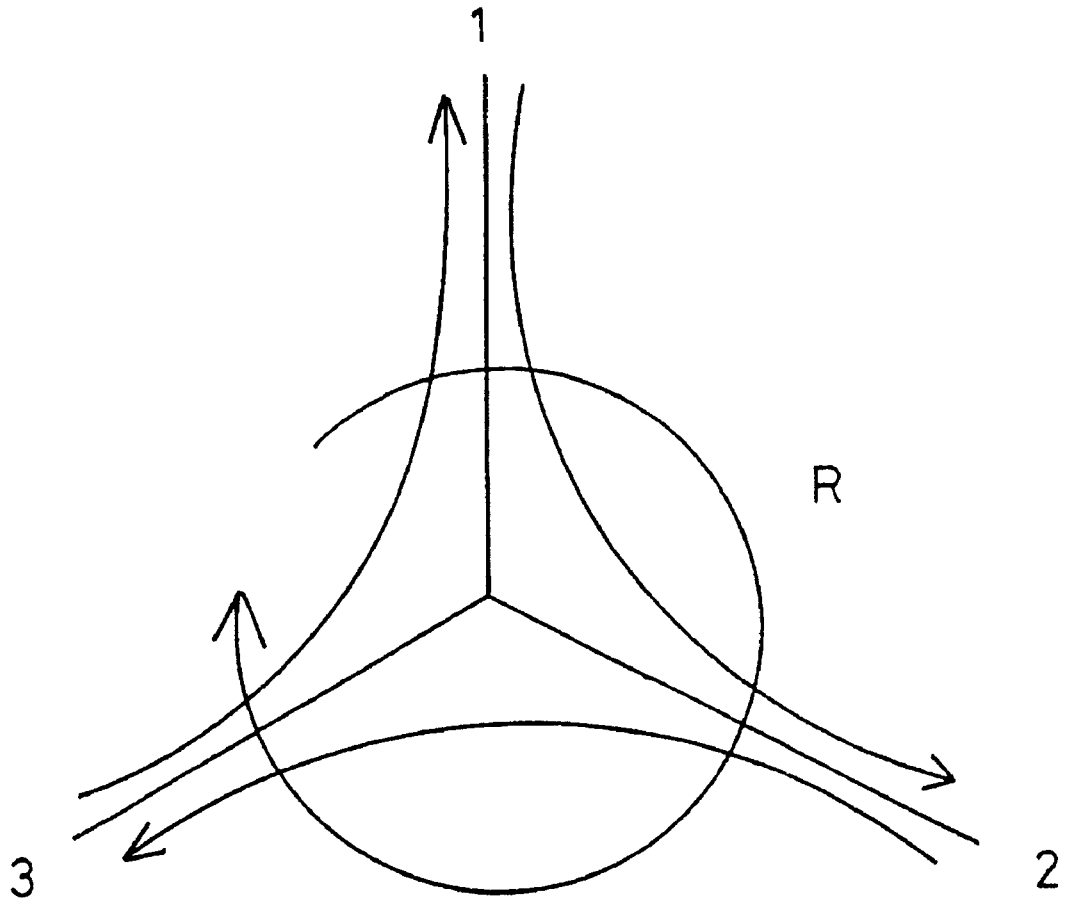
FIG. 1: is a diagrammatical representation of the power transmissions of an ideal circulator.
Figure 2:
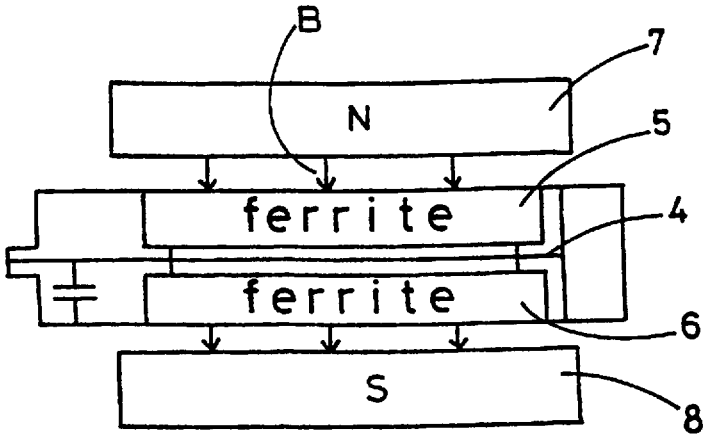
FIG. 2 PRIOR ART
FIG. 2: shows a cross-sectional view of a typical prior art circulator.
Figure 3:
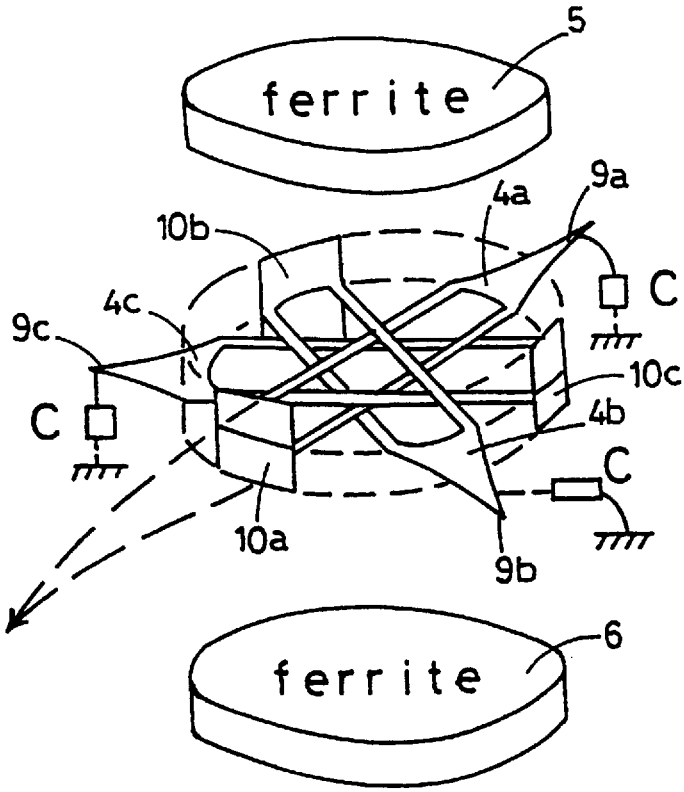
FIG. 3 PRIOR ART
FIG. 3: shows an exploded view of the circulator of FIG. 2.
Figure 4:
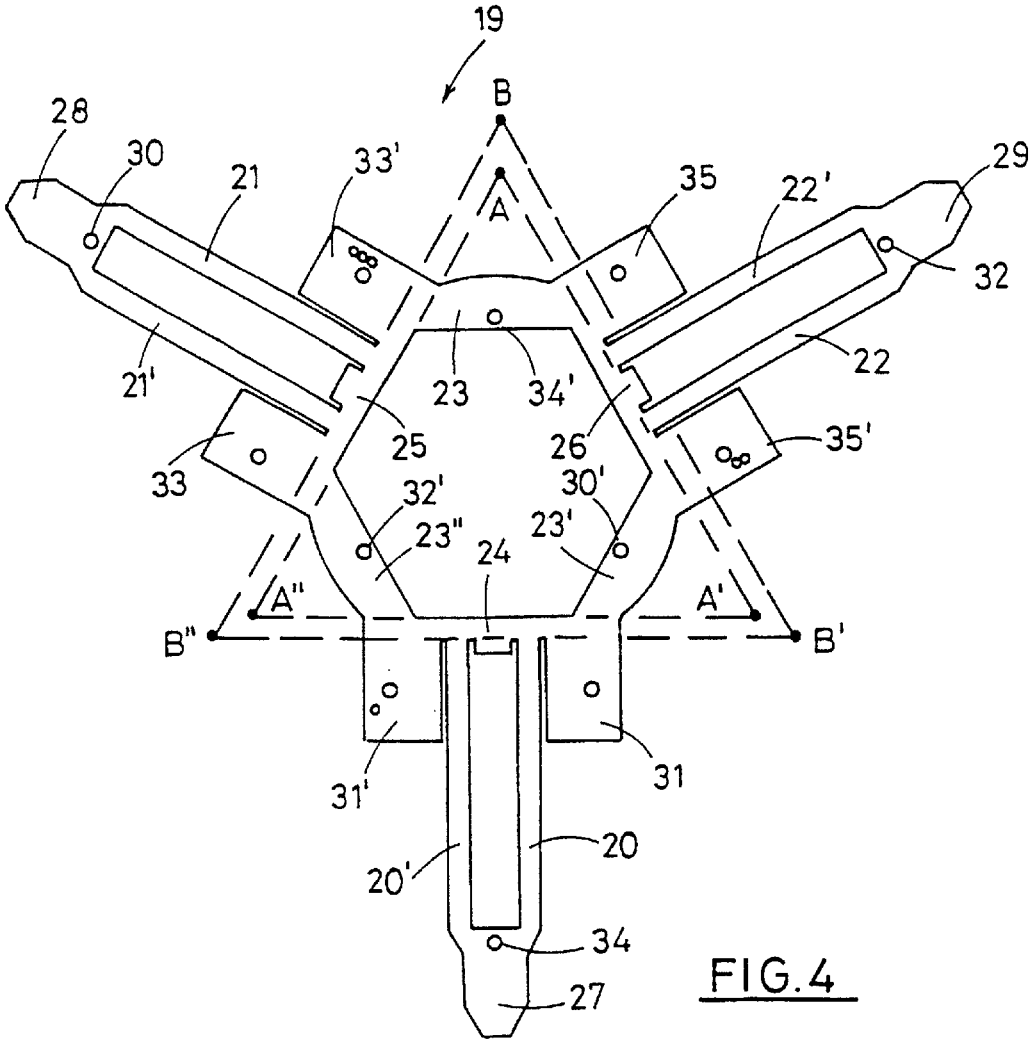
FIG. 4: shows an unfolded conductor arrangement.

FIG. 4 shows the topology of an integrally formed conductor arrangement 19 for a circulator formed from a thin sheet or foil of copper, although any suitable electrically conductive material may be used. The pattern of conductor arrangement 19 may be obtained by any appropriate process such as etching, stamping, photolithography etc. Conductor arrangement 19 is seen to comprise strips 20,20', 21,21' and 22,22' (for concern referral to benefits collecting gas 20, 21 and 22) connected to a base portion 23, 23', 23". As the strips 20, 21 and 22 are integrally formed with base 23 it is ensured that ends 24, 25 and 26 of strips 20, 21 and 22 form a good electrical connection with one another and a common ground plane. A more preferred topology 69 is shown in FIG. 6 which incorporates stripes 70, 71 and 72 to facilitate connection to trimming capacitors and tapered ends 73, 74 and 75 to facilitate direct connection to strip line connectors.

Once a conductor layout 19 is produced the strips 20, 21 and 22 must be folded to form the desired configuration of overlapping crossing strips. That part of the pattern to the right from the line AA' including strips 22,22' pads 35,35' and stripe 26 is folded inwards 90° along the line AA'. Then end 29 of strip 22 is further folded inwards 90° and pads 35,35' are folded outward 90° along the line BB'. The same manipulations are subsequently performed with the other strips. End 27 of strip 20, stripe 24 and adjacent pads 31, 31' are folded along the lines A"A' and B"B'. Finally, end 28 of strip 21, stripe 25 and adjacent pads 33, 33' are folded along the lines A"A and B"B.

Figure 6:
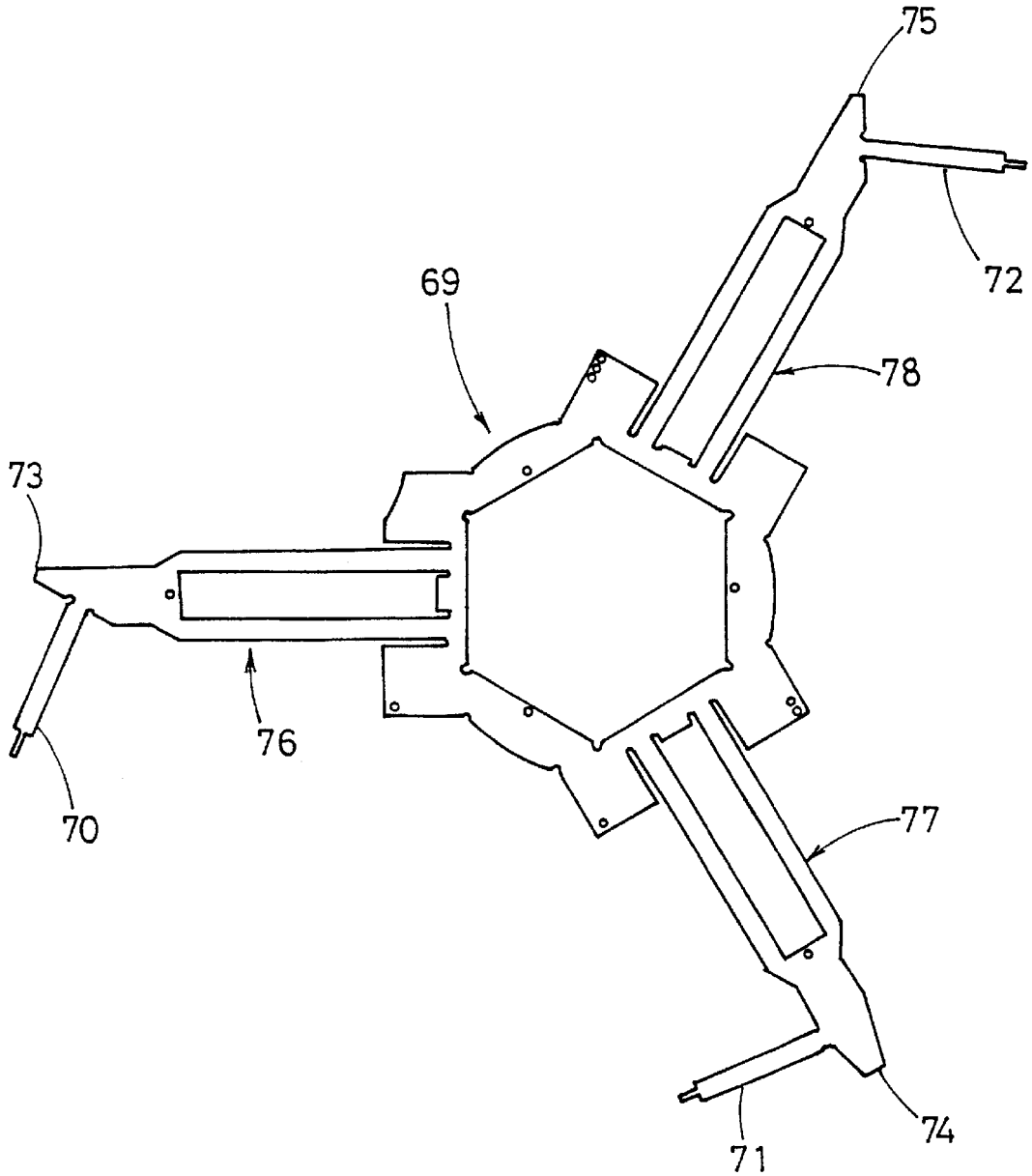
FIG. 6: shows an unfolded conductor arrangement according to a preferred embodiment.
Figure 7:
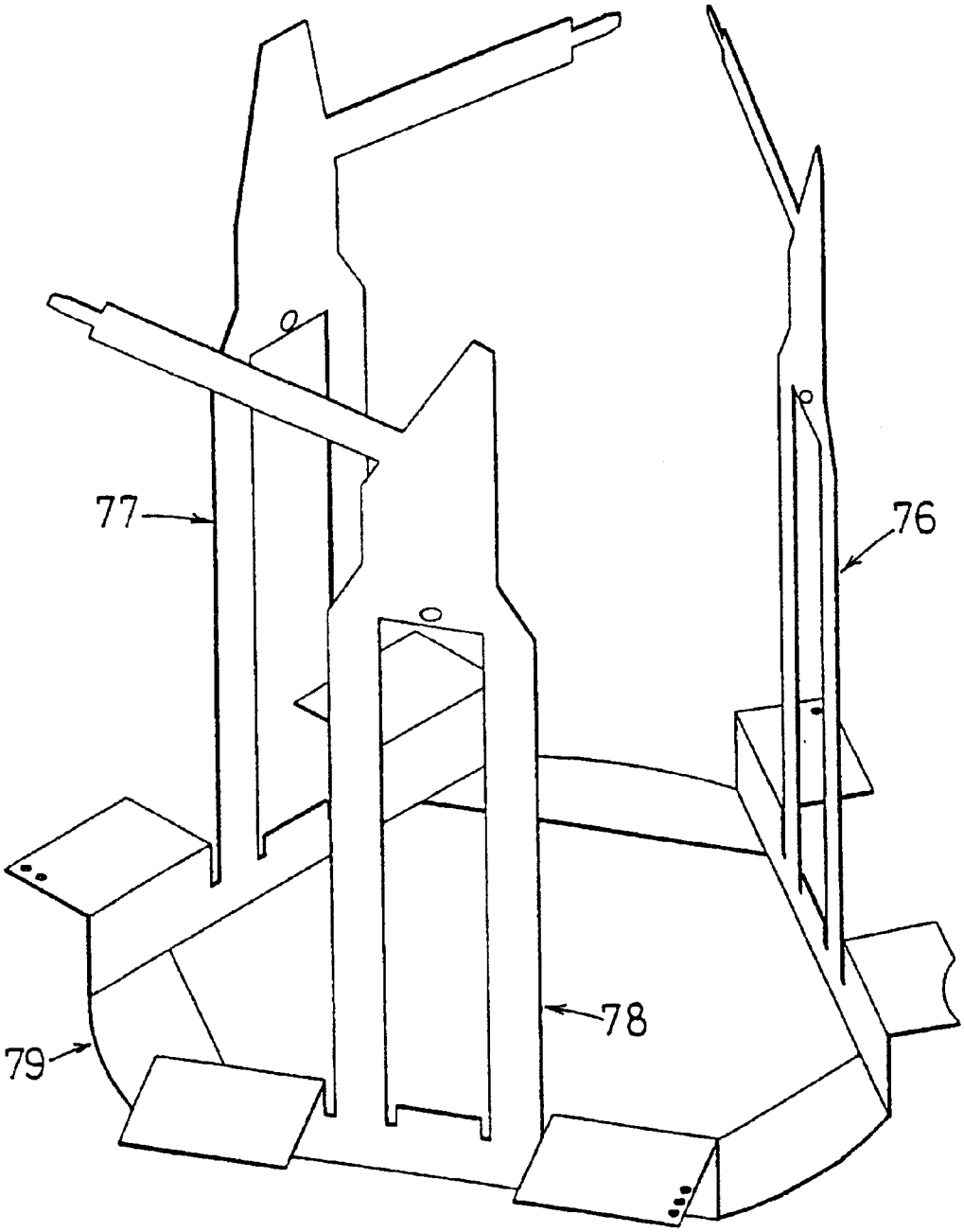
FIG. 7: shows the strip conductors of the topology shown in FIG. 6 when folded inwardly by 90°.
Figure 8:
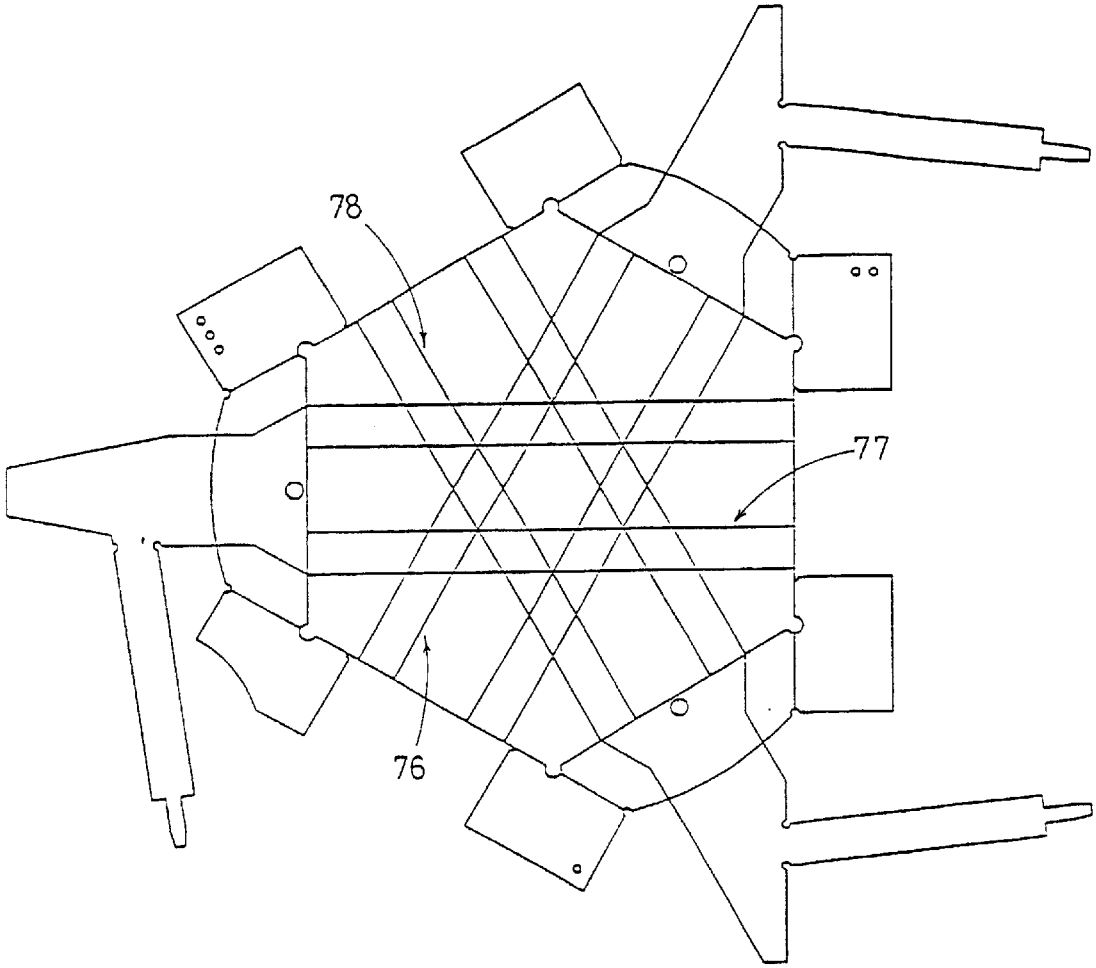
FIG. 8: shows the strip conductors of the topology shown in FIG. 6 when folded inwardly 180°.

This is shown diagrammatically in FIGS. 7 to 8 for the topology of FIG. 6. FIG. 7 shows the strips 76, 77, 78 folded 90° inwardly and FIG. 8 shows the strips 76, 77 and 78 after they have been folded inwardly through 180°.

Dielectric film spacers are inserted between overlapping conductors 20,21 and 22 (or 76, 77 or 78) after each fold to avoid direct electrical contact between adjacent strips 20, 21, and 22. Ends 27, 28 and 29 of strips 20, 21 and 22 may be connected to respective terminal ports of a circulator in use. Ends 73, 74 and 75 of conductor arrangement 69 may be connected to ports of a circulator or directly to strip line connectors.

It will be seen that the strips may be easily formed simultaneously from a single sheet by virtue of the integral conductor topology. The conductor pattern may be easily fabricated simply by folding sections to the position shown in FIG. 5. Chip capacitors 36, 37, 38 used for circulator impedance matching, may be fitted between conductors 20, 21 and 22 and ground conductor 23 between aperture pairs 30, 30'; 32, 32'; and 34, 34'. The integral formation of the conductor layout avoids losses and faults in multiple contact joints of strips to a common electrical ground experienced in prior art arrangements. The integral topology of the conductors locates the position of conductors and enables the topological symmetry of the structure to be consistently reproduced.

Figure 5:
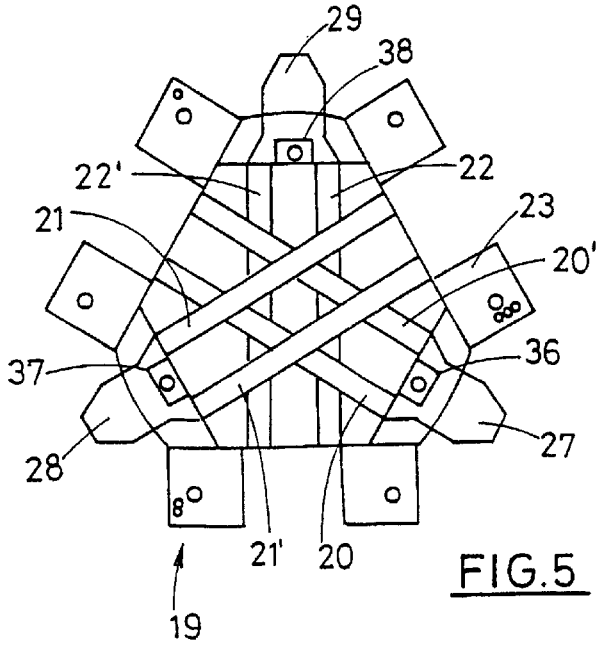
FIG. 5: shows the conductors of FIG. 4 folded into the "in use" configuration.
Figure 9:
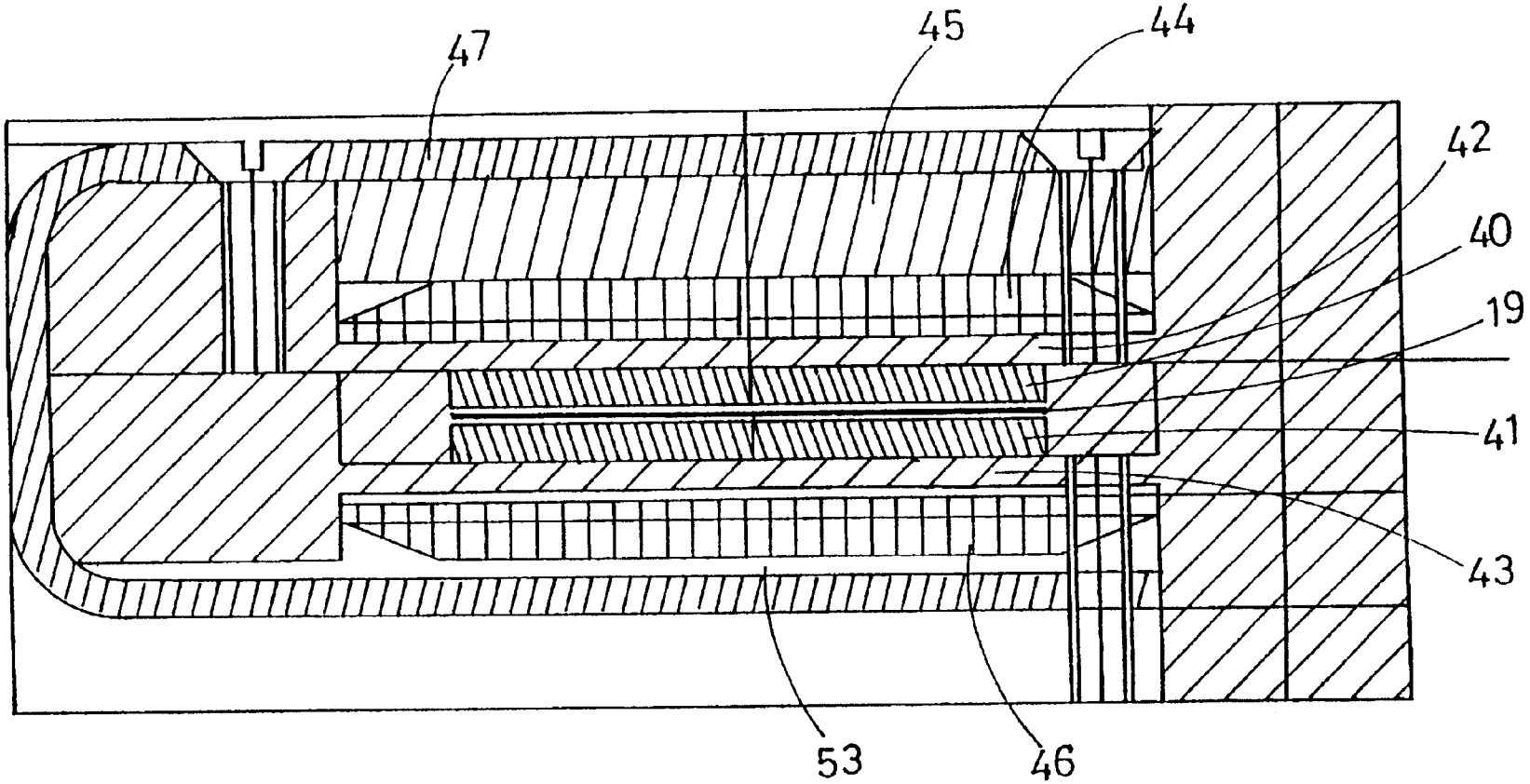
FIG. 9: shows a side cross-sectional view of the circulator in accordance with the invention.

FIG. 9 shows a cross-sectional view of the circulator incorporating the conductor arrangement 19 shown in FIG. 5. The region where strips 20, 21, and 22 intersect is sandwiched between ferrite discs 40 and 41. Silver plated aluminium or copper layers 42 and 43 are an integral part of the circulator housing body which act as ground planes and assist in effective heat transfer from ferrite discs 40 and 41. U shaped yoke 47 provides an easy path for the magnetic flux from permanent magnet 45 to ferrite disks 40,41. Magnetic lens 44 is located adjacent to disc-shaped permanent magnet 45. A similar lens 46 is provided on the opposite side of the magnetic circuit. This means that the magnetic circuit effectively concentrates the magnetic field and enhances the uniformity of the internal magnetic field inside the ferrite disks 40,41.

Figure 10:
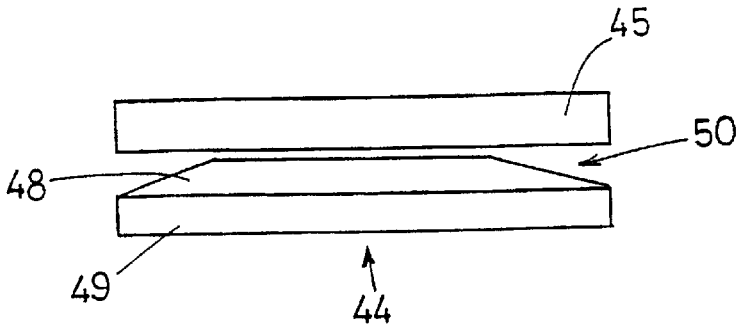
FIG. 10: shows a disk-shaped magnet and lens of the circulator.
Figure 11:
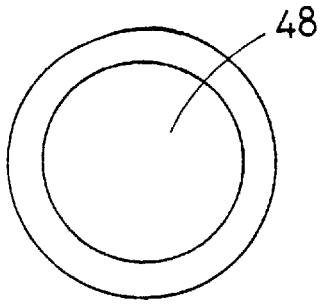
FIG. 11: shows a top view of the lens shown in FIG. 7.

Referring now to FIGS. 10 and 11 the magnetic lens is shown in more detail. Lens 44 is seen to have a disc-shaped portion 49 and a frusto-conical portion 48. The top face of frusto-conical portion 48 is positioned adjacent to magnet 45 so that there is a cut-away section 50 providing an increasing air gap between lens 44 and the edge of magnet 45 in the radial direction of magnet 45. The cut-away section 50 compensates for non-uniformity of magnetic field distribution caused by irregularities of the magnetic circuit and/or shape of magnet 45. As the strength of the magnetic field varies across, the surface of magnet 45 due to the magnet "edge effect" or other discontinuities (stronger magnetic field at the edge of magnet 45) lens 44 serves to flatten the magnetic field profile and ensure a substantially homogeneous internal magnetic field inside ferrite disks 40 and 41. The more uniform the magnetic field the lower the magnetic insertion losses in the circulator.

Figure 12:
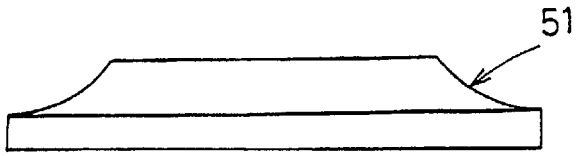
FIG. 12: shows a lens having concave cut-away portions.
Figure 13:
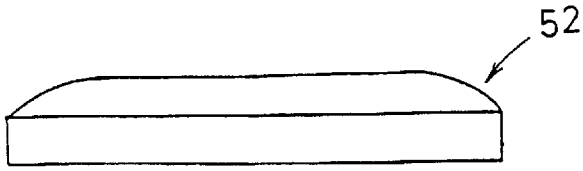
FIG. 13: shows a lens having convex cut-away portions.

Referring now to FIG. 12 a modification is shown wherein the cut-away portion 51 of the lens is concave. FIG. 13 shows a variant in which the cut-away portion 52 is convex. The shape of the cut-away portion will depend upon the shape of the permanent magnet and the aspect ratio of magnet and ferrite disks to be compensated. The shape of frusto-conical lens 44 shown in FIG. 10 is preferred due to its ease of fabrication. The lens is preferably formed of a magnetically soft material, e.g. iron or magnetic steel.

Figure 14:
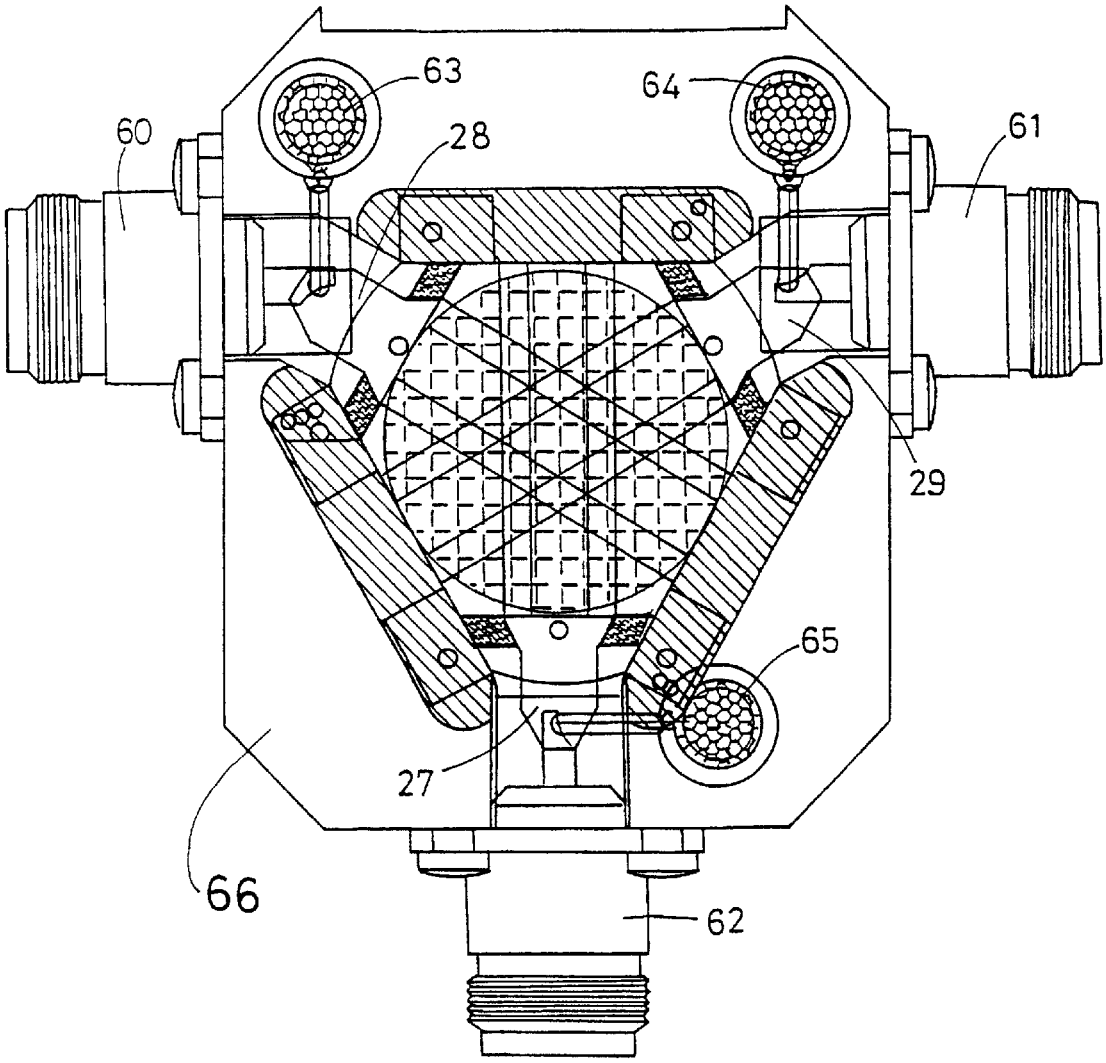
FIG. 14: shows a top plan view of a circulator incorporating a conductor arrangement of the form shown in FIG. 5.

Referring now to FIG. 14 ends 27, 28 and 29 of conductors 20, 21 and 22 (shown in FIGS. 4 and 5) are seen to be attached to connectors 60, 61 and 62. Adjustable capacitors 63, 64 and 65 may be connected between ends 27, 28, 29 and a ground plane for the purpose of impedance matching and tuning the circulator to different operating frequencies. When the operating frequency is fixed, chip capacitors 36, 37 and 38 may also be used for this purpose (as shown in FIG. 5) and adjustable capacitors 63, 64 and 65 may be redundant. Conversely, chip capacitors 36,37 and 38 may be redundant at higher frequencies and only adjustable capacitors 63, 64 and 65 may be sufficient for circulator operation. Tabs 33, 33', 31, 31', 35 and 35' are tightly clamped between the halves of the housing body 66 so that they provide a reliable electrical connection between the ground plane of the housing 66 and the conductor arrangement.

Figure 15:
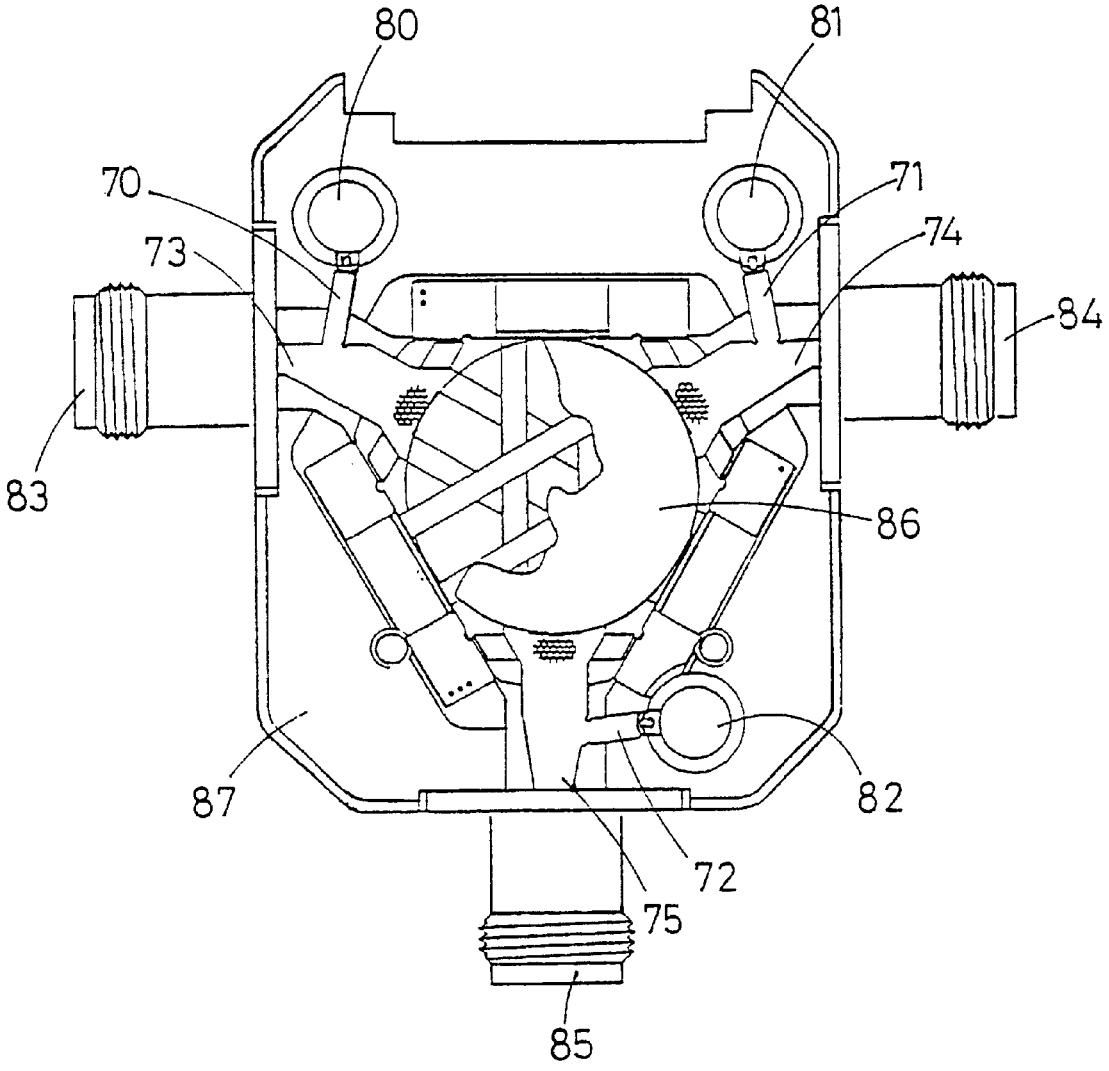
FIG. 15: shows a plan view of a circulator incorporating a conductor arrangement of the form shown in FIG. 8.

FIG. 15 shows a partially cut away plan view of a circulator incorporating a conductor arrangement as shown in FIG. 8. Ends 73, 74 and 75 are connected to respective connectors 83, 84 and 85. Strips 70, 71, 72 are connected to respective adjustable trimming capacitors 80, 81 and 82. Ferrite 86 is shown partially cut away. The circulator is mounted within housing body 87.

Referring again to FIG. 9, it is important to note that ferrite disks 40 and 41 form an essential part of the closed dc magnetic circuit and contribute to its reluctance. Thus, the ferrite internal dc magnetic field becomes a substantially nonlinear function of magnetisation of saturation $4/\pi M_s$—a fundamental magnetic characteristic of a ferrite. The ferrite disks 40 and 41 will preferably be formed of a material selected to have $4\pi M_s$ characteristics such that variation of effective RF permeability of the ferrite with temperature is minimised. To achieve this, the magnet, yoke, ferrite and lenses must all be considered as constituents of the closed magnetic loop where the particular combination of magnet and ferrite provides a mechanism of thermal feedback to the dc magnetic circuit in response to changes in temperature.

Figure 16:
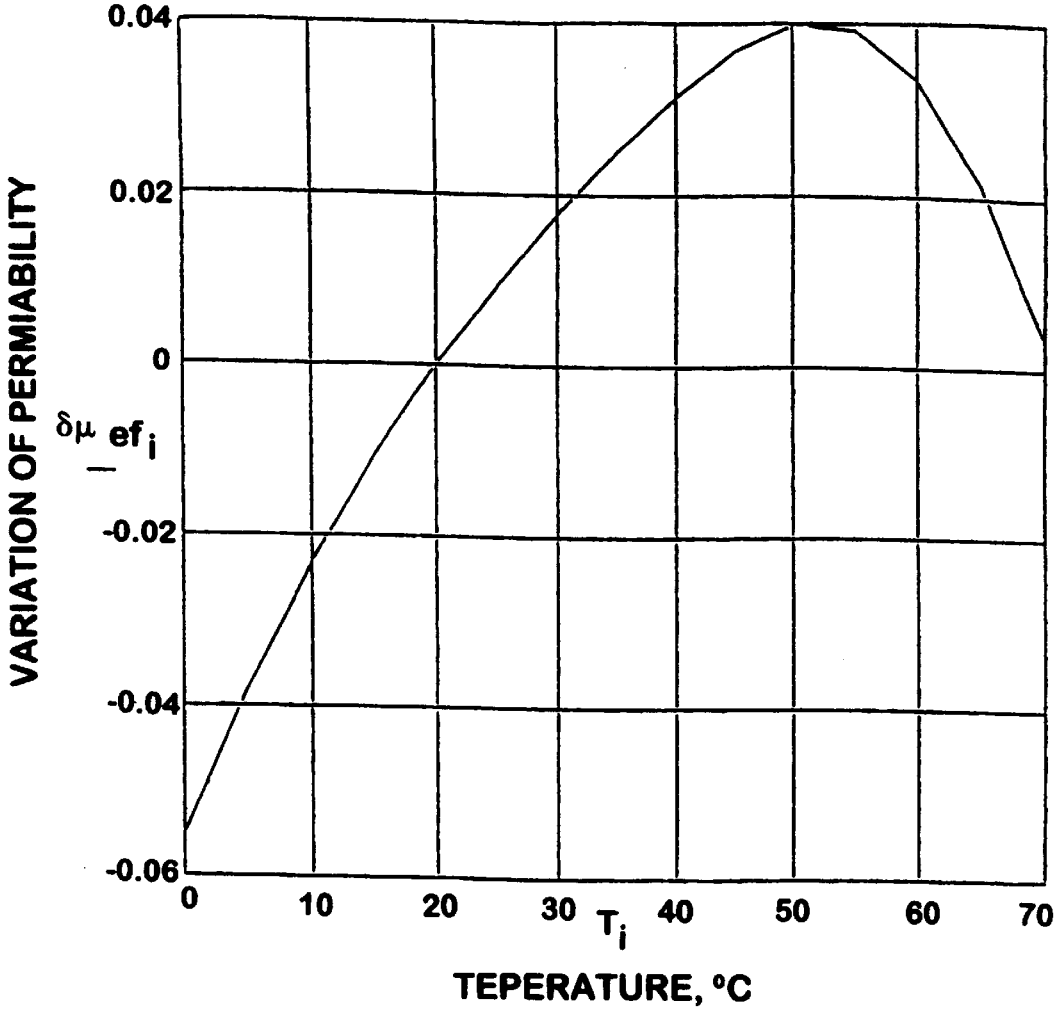
FIG. 16: shows the variation of effective permeability with temperature when thermal compensation is provided.
Figure 17A:
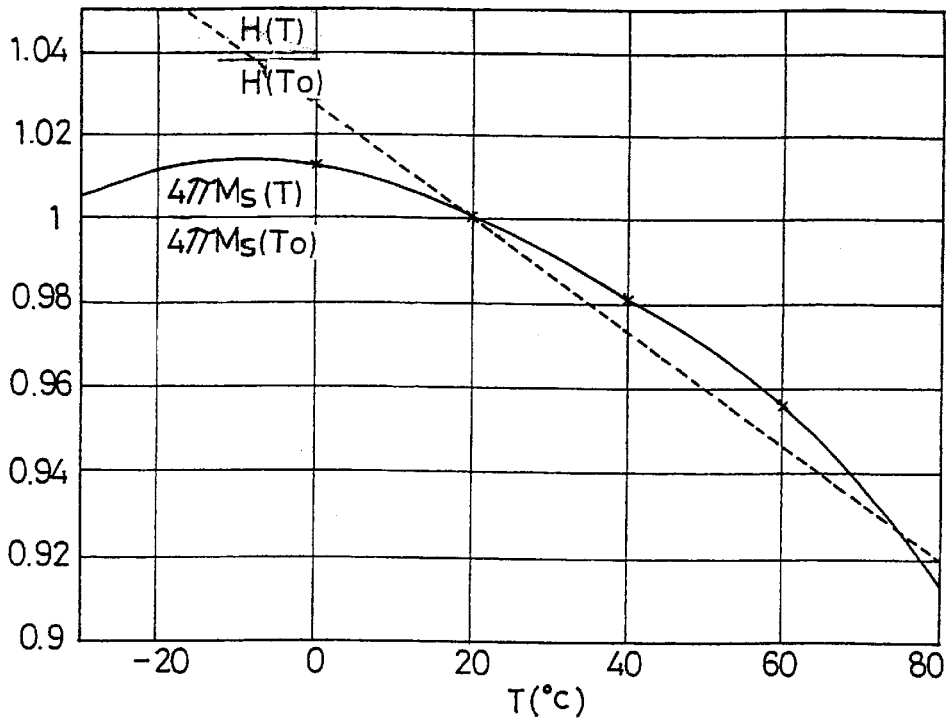
FIG. 17*a*: shows the relative variation of the normalised magnetic field strength of the magnet and the normalised magnetisation of saturation of the ferrite with temperature.
Figure 17B:
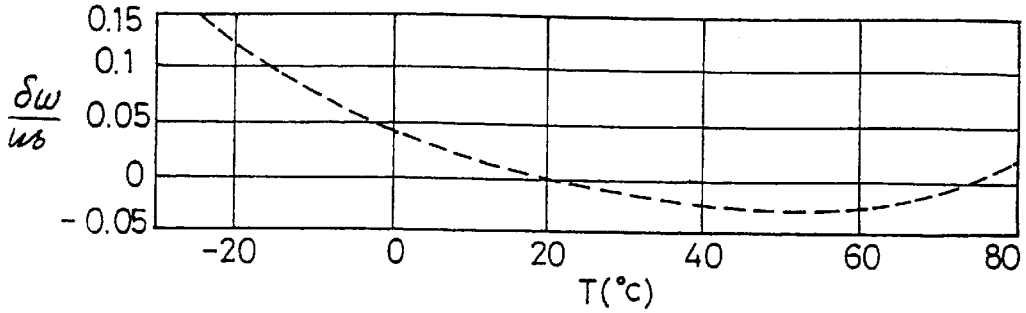
FIG. 17*b*: shows relative changes in the central operating frequency with changes in temperature.

The plots of FIGS. 16, 17*a* and 17*b* illustrate the concept of thermal stabilisation of the circulator in which the microwave ferrite acts as a part of the closed dc magnetic circuit. An ideal circulator would be temperature stable if the RF effective permeability $\mu_e$ of the ferrite remained constant across the specified temperature range. It implies that the external biasing magnetic field ($H_e$) needs to change coherently with variations of the ferrite magnetisation of saturation ($4\pi M_s$). However, because of fundamental differences in physical properties of RF ferrites and permanent magnets, their typical temperature characteristics vary in different manners. Nevertheless pertinent combinations of ferrite and magnet allow thermal instability of the circulator to be substantially minimised. In the proposed circulator embodiment deviations of the central frequency with temperature have been reduced because this depends upon the difference between $H_e$ and $4\pi M_s$ but not on each of these parameters separately.

For example, a combination of the microwave ferrite Gd8E and an FB permanent magnet, both produced by TDK Corporation of Tokyo, Japan, are used in the circulator operating in the 80 MHz to 390 MHz frequency range in the above resonance mode (i.e. the operating frequency is below ferromagnetic resonance). The plot of FIG. 17*a* demonstrates that $H_e$ rises faster that $4\pi M_s$ when temperature is decreasing. It results in decreasing $\mu_e$ (FIG. 16) and subsequent shifting of the normalised central frequency towards higher values ($\delta\omega>0$) at temperatures below 20° C. (FIG. 17*b*). However, deviation of the central frequency gives rise to insertion losses that in turn causes temperature rise and shifting the central frequency back towards the initial operating frequency. This mechanism provides a feedback for temperature auto-stabilisation at lower temperatures.

At elevated temperatures the curve of $4\pi M_s$ intersects the $H_e$ curve again at a temperature of about 75° C. owing to the essential non-linearity of the $4\pi M_s$ curve. Above the latter temperature $4\pi M_s$ decreases faster than $H_e$ and, consequently, the central frequency of circulator may increase with temperature indefinitely.

In the temperature range between the crossing points 20° C. and 75° C.) the circulator is temperature stable i.e. thermal variations of the central frequency are confined between zero and the maximum deviation at 52° C.

Other combinations of permanent magnets and ferrite materials may be employed in the frame of this concept of thermal stabilisation. When using ferrites with more linear dependence of $4\pi M_s$ (such as Al or Ca doped garnets) the specific non-linearity in $H_e$ temperature dependence may be introduced by incorporating a thermocompensating material in the magnetic circuit.

If required, to further stabilise the effective RF permeability of the ferrite with temperature change, a layer of thermocompensating material may be incorporated into the magnetic circuit between lenses 44, 46, and yoke 47. This material is preferably a Nickel-iron alloy, such as THERMOFLUX produced by VAC Gmbh, of Hanu, Germany. Preferably, however, the thermal performances of ferrite discs 40 and 41 and magnet 45 can be matched so that no such additional thermal compensation is required.

Further, a magnetic shielding material may be provided about the circulator to decrease the strength of fringing magnetic fields emanating from the circulator. Such shielding may be achieved by securing a magnetic shielding material such as MAGNIFIER 75, produced by VDM Technologies of Parsippany, N.J., to the housing body of the circulator. The shielding material is preferably secured to at least the mounting side of the circulator and is to be positioned so that it does not affect the thermal compensation of the circulator.

In use, variable air gap 53 (see FIG. 9) may be employed to adjust the central operating frequency by altering the intensity (not shape) of the biasing magnetic field. Matching and tuning may be effected by chip capacitors 36, 37 and 38 and/or adjustable capacitors 63, 64 and 65.

Although the embodiment described above is based on one permanent magnet, a pair of permanent magnets or an electromagnet may be employed. When an electromagnet is used the magnetic field intensity may be varied to sweep the operating frequency or reverse the direction of the magnetic field to change the direction of circulation. It is also to be appreciated that the magnet may be placed at a different position in the magnetic circuit. For example, the magnet may replace the upright portion of the yoke so as to have lateral arms form the top and bottom of the magnet conveying magnetic flux to the lenses.

Ferrite layers 40 and 41 (having very poor thermal conductivity) are preferably thin enough to enable heat dissipated in the ferrite to be efficiently transferred outside of the circulator. Thin polycrystal slabs or thick single crystal film ferrites may be used for this and incorporated with superconducting materials to further reduce insertion losses in the circulator.

It will thus be seen that the present invention provides a conductor topology which is easily fabricated, provides good electrical connection between conductors, and enables improvements of assembly accuracy. It also provides good thermal and electrical connection between the ferrite and the ground plane. The use of magnetic lenses produces a substantially uniform internal magnetic field inside of the ferrite discs. Incorporating ferrite disks into a magnetic flux path enables thermal auto-stabilisation of circulator performance due to coherent thermal variations of the biasing magnetic field and magnetisation of saturation of the ferrite material.

By selecting the thermal characteristics of the ferrite discs and the permanent magnet thermal stability of circulator may be achieved without additional temperature compensating components.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope of the present invention as defined in the appended claims.

What is claimed is:

1. An integral conductor arrangement for a circulator of the type having a magnetic biasing field applied comprising a plurality of overlying spaced apart crossing strips attached at one end to a base portion having an opening therein and forming a first compartment adapted for receiving a ferrite block therein;

wherein the ferrite block is adapted to be inserted into the first compartment with one face of the ferrite block located adjacent the strips while an opposite face of the ferrite block is exposed to allow direct contact with a circulator housing body.

2. A conductor arrangement as claimed in claim 1 wherein the base portion defines a second compartment, opposite the first compartment, to contain a further ferrite block such that when one face of each ferrite is placed adjacent the strips the other face of each ferrite is exposed to allow direct contact with a circulator housing body.

3. A conductor arrangement as claimed in claim 1 wherein the base portion includes portions projecting therefrom to abut against the peripheral edges of each ferrite block to locate it in position.

4. A conductor arrangement as claimed in claim 1 wherein the base portion includes outwardly extending tabs about its periphery for connection to a housing body.

5. A conductor arrangement as claimed in claim 1 wherein capacitors are embedded underneath the strips between the distal ends of the strips and the base portion.

6. A conductor arrangement as claims in claim 1 wherein each strip comprises a pair of substantially parallel strips and integrally formed stripes are provided at the distal end of each pair of substantially parallel strips for connection to a trimming capacitor.

7. A conductor arrangement as claimed in claim 1 wherein the conductor arrangement is formed from a sheet of conducting material.

8. A circulator comprising a conductor arrangement as claimed in claim 1 having a ferrite block placed in the first compartment and a magnet which provides said magnetic biasing field to the ferrite block.

9. A circulator as claimed in claim 8 having a second compartment located opposite the first compartment wherein ferrite blocks are located within the first and second compartments and ground planes are placed in direct electrical and thermal connection with the faces of the ferrite blocks opposite the strips.

10. A circulator as claimed in claim 8 wherein a ground plane is placed in electrical and thermal contact with the exposed face of the ferrite block opposite the conductors.

11. A circulator as claimed in claim 10 wherein the base portion is clamped to a circulator housing and wherein the ground plane is part of the housing of the circulator.

12. A method of forming a conductor arrangement for a circulator of the type having a magnetic biasing field applied comprising the steps of:

i) forming an integral conductor arrangement consisting of a plurality of strips extending outwardly from a base portion having an opening therein;

ii) folding the arrangement to define a first compartment to contain a ferrite block; and iii) folding the strips inwardly without said ferrite block being inserted into the first compartment to form an arrangement of spaced apart overlaying crossing strips.

13. A method as claimed in claim 12 wherein first portions of the base portion are folded inwardly to form upright surfaces which locate the ferrite block in the first compartment.

14. A method as claimed in claim 13 wherein second portions of the base portion are folded outwardly to provide tabs for ground connection to a housing body.

15. A method as claimed in claim 12 wherein capacitors are connected beneath the strips between the distal ends of the strips and the base portion.

* * * * *